US009089867B2

(12) United States Patent
Link et al.

(10) Patent No.: US 9,089,867 B2
(45) Date of Patent: Jul. 28, 2015

(54) METHOD AND DEVICE FOR ELECTROSTATICALLY SEPARATING OVERSPRAY WITH AN ABSORPTION AGENT

(75) Inventors: Kersten Link, Grafenau (DE); Werner Swoboda, Boeblingen (DE); Erwin Hihn, Walddorfhaeslach (DE); Juergen Hanf, Tuebingen (DE)

(73) Assignee: EISENMANN AG, Boeblingen (DE)

( * ) Notice: Subject to any disclaimer, the term of this patent is extended or adjusted under 35 U.S.C. 154(b) by 400 days.

(21) Appl. No.: 13/515,870

(22) PCT Filed: Nov. 24, 2010

(86) PCT No.: PCT/EP2010/007120

§ 371 (c)(1),
(2), (4) Date: Jul. 13, 2012

(87) PCT Pub. No.: WO2011/072796

PCT Pub. Date: Jun. 23, 2011

(65) Prior Publication Data

US 2013/0032089 A1 Feb. 7, 2013

(30) Foreign Application Priority Data

Dec. 15, 2009 (DE) ..... 10 2009 058 206

(51) Int. Cl.
*B03C 3/14* (2006.01)
*B03C 3/34* (2006.01)
(Continued)

(52) U.S. Cl.
CPC ..... *B05B 15/1244* (2013.01); *B03C 3/013* (2013.01); *B03C 3/017* (2013.01); *B03C 3/53* (2013.01); *B03C 2201/28* (2013.01); *B05B 15/1262* (2013.01)

(58) Field of Classification Search
CPC ..... B03C 3/00; B03C 3/013; B03C 3/017; B03C 3/40; B03C 3/47–3/53; B03C 3/60–3/64; B03C 2201/20; B03C 2201/28; B05B 15/12; B05B 15/1244; B05B 15/1262
USPC ..... 55/DIG. 46; 95/57, 58; 96/52, 53; 118/326, 620
See application file for complete search history.

(56) References Cited

U.S. PATENT DOCUMENTS 2,547,573 A 4/1951 Gannone
3,932,151 A * 1/1976 Lau ..... 96/325
(Continued)

FOREIGN PATENT DOCUMENTS

DE 40 90 626 T5 4/1992
DE 199 31 378 A1 1/2001
(Continued)

OTHER PUBLICATIONS www.de.wikipedia.org/wiki/Viskosit%/C3%A4t (cited in German Patent Office Action, accessed Jun. 9, 2010) (Translation of page made Aug. 13, 2012).

*Primary Examiner* — Duane Smith
*Assistant Examiner* — Sonji Turner
(74) *Attorney, Agent, or Firm* — Factor Intellecltual Property Law Group, Ltd.

(57) ABSTRACT

A method for separating overspray from the cabin exhaust air of coating systems, in particular of painting systems, which is laden with overspray, the overspray is taken up by an air flow and conveyed to an electrostatically operating separating device. There, the bulk at least of the solids is separated from the overspray at at least one separating surface. An electrically conductive material or material mixture is used as a separating agent, which is applied to the at least one separating surface of the separating device and at the operating temperature of the separating device has a wax-like consistency. Also a separating device with such a wax-like material and a system for coating articles.

33 Claims, 11 Drawing Sheets

(51) Int. Cl.

| | |
|---|---|
| ***B05B 15/12*** | (2006.01) |
| ***B03C 3/013*** | (2006.01) |
| ***B03C 3/017*** | (2006.01) |
| ***B03C 3/53*** | (2006.01) |

(56) References Cited

U.S. PATENT DOCUMENTS

| | | | | | |
|---|---|---|---|---|---|
| 5,039,313 | A * | 8/1991 | Gocht | ..... | 95/65 |
| 5,264,014 | A * | 11/1993 | Lannefors et al. | ..... | 96/44 |
| 2002/0017223 | A1 * | 2/2002 | Summerfield | ..... | 106/620 |
| 2010/0197213 | A1 | 8/2010 | Holzheimer | | |
| 2010/0291848 | A1 | 11/2010 | Swoboda | | |

FOREIGN PATENT DOCUMENTS

| | | | |
|---|---|---|---|
| DE | 103 61 266 | A1 | 7/2005 |
| DE | 10 2004 060 593 | A1 | 6/2006 |
| DE | 10 2007 036 553 | A1 | 2/2009 |
| DE | 10 2007 040 900 | A1 | 2/2009 |
| DE | 10 2008 038 754 | A1 | 2/2010 |
| WO | 90/12649 | A1 | 11/1990 |

* cited by examiner

METHOD AND DEVICE FOR ELECTROSTATICALLY SEPARATING OVERSPRAY WITH AN ABSORPTION AGENT

RELATED APPLICATIONS

This application claims the filing benefit of International Patent Application No. PCT/EP2010/007120, filed Nov. 24, 2010, which claims the filing benefit of German Patent Application No. 10 2009 058 206.1 filed Dec. 15, 2009, the contents of both of which are incorporated herein by reference.

TECHNICAL FIELD AND BACKGROUND OF THE INVENTION

The invention relates to a method for separating overspray from the overspray-laden booth exhaust air of coating systems, particularly painting systems, in which the overspray is taken up by an air stream and conveyed to an electrostatically operating separating device where the bulk at least of the solids is separated from the overspray on at least one separating surface.

The invention moreover relates to a device for separating overspray from the overspray-laden booth exhaust air of paint systems having a) at least one separating surface along which the booth exhaust air can be conveyed and which is connected to a terminal of a high voltage source;

b) an electrode device which is arranged in the air stream, is associated with the separating surface and is connected to the other terminal of the high voltage source.

The invention furthermore relates to a system for coating, particularly painting, objects, particularly vehicle bodies, having a) a coating booth in which the objects can be acted upon by coating material and through which an air stream can be conducted, which takes up and removes resultant overspray particles of the coating material;

b) an electrostatically operating separating device.

When paints are applied manually or automatically to objects, a substream of the paint, which generally contains both solid bodies and/or binding agent as well as solvent, is not applied to the object. This substream is known among experts as "overspray". The overspray is taken up by the air stream in the paint booth and supplied for separation so that, if required, the air can be conveyed back to the coating booth after suitable conditioning.

Particularly in systems with a relatively high paint consumption, for example in systems for painting vehicle bodies, wet separation systems are preferably used. In commercially known wet separators, water flows together with the booth exhaust air coming from above to a nozzle accelerating the air stream. A swirling of the through-flowing booth exhaust air with the water takes place in this nozzle. During this procedure, the overspray particles largely pass over into the water so that the air exiting the wet separator has been substantially cleaned and the paint overspray particles remain separated in the water. They can then be recovered from this or disposed of.

In known wet separators, a relatively high amount of energy is needed to circulate the very large quantities of water required. Treating the rinsing water is costly due to the elevated use of paint-binding and detackifying chemicals and the disposal of paint sludge. Furthermore, as a result of the intensive contact with the rinsing water, the air absorbs a great deal of moisture which, in recirculating-air mode, in turn leads to a high energy consumption for treating the air.

In contrast, in commercially known devices of the type mentioned at the outset, a dry separation process is used in that paint overspray particles which are entrained by the booth exhaust air flowing past are ionised by the electrode device and, owing to the electrical field established between the separating surface and the electrode device, migrate to the separating surface on which they are separated. The paint overspray particles adhering to the separating surface can then be stripped off this mechanically, for example, and transported away.

The cleaning effect of such separators is very good. However, for continuous operation, it is necessary to always ensure that a sufficiently strong electrical field can build up between the separating surface and the electrode device, which is only possible up to a certain layer thickness of paint overspray on the separating surface, since such a layer has an insulating effect. However, the necessary continuous removal of the paint overspray from the separating surface involves complex structural measures and can be prone to faults. It is moreover possible that overspray will react, harden or dry on the separating surface so that it can no longer be simply removed by being stripped off the separating surface.

SUMMARY OF THE INVENTION

An object of the present invention, therefore, is to provide a method, a separating device and a system of the type mentioned at the outset, which address these problems.

This object may be achieved in the method of the type mentioned at the outset in that an electrically conductive material or material mix is used as the separating agent, which is applied to the at least one separating surface of the separating device and has a wax-like consistency at the operating temperature of the separating device.

Therefore, according to an embodiment of the invention, a wax-like material is used as the separating layer between the separating surface and the overspray so that this latter cannot come into contact with the separating surface. The specified nature of the separating agent means that the separating agent can be easily stripped or shaved off the separating surface, whereby overspray adhering to it is removed from the separating surface and can supplied for disposal or, if required, for treatment.

The consistency of the separating agent is selected so that it adheres, but does not stick, to the separating surface over its desired period of use. Here, a material is understood to be wax-like if its viscosity at the operating temperature is greater than approximately 2000 mPa s. The viscosity of the separating agent is preferably greater than 2500 mPa s, more preferably greater than 3000 mPa s and particularly preferably greater than 4000 mPa s.

The separating agent preferably has a consistency which is comparable to that of hard paraffin at the operating temperature. A block of chocolate also has a similar consistency, for example. This means that the separating agent is substantially solid at the operating temperature, with it being possible to shave flakes off the separating agent.

The separating agent alternatively has a plastic consistency at the operating temperature. For example, a suitable consistency is comparable with that of grease, paraffins such as Vaseline, soaps, waxes and gels. A separating agent of this type is kneadable or spreadable at the operating temperature.

The operating temperature is normally below approximately 28° C.

If the viscosity of the separating agent reduces at a temperature above the operating temperature, this can be utilised to apply the separating agent in a warmer state in a more liquid form to the separating surface, where it becomes more viscous at the operating temperature and remains substantially dimensionally stable. If the separating agent is sprayable in a warmer state, the separating agent can be applied accordingly by spraying.

It is favourable if the separating agent is substantially inert with respect to the separated solids. This prevents an undesired reaction between the separating agent and the overspray from the outset.

It has proven expedient if the separating agent comprises a grease, a paraffin, a soap, a wax or a gel.

If the aim is to avoid continuously stripping off the overspray, when a wax-like material is used as a separating agent it is possible for the separating agent with separated solids which is present on the at least one separating surface to be removed after an operating period and an unladen separating agent to be applied to the at least one separating surface. The separating surface can therefore be cleaned at intervals.

It is advantageous if separating agent with separated solids is removed by means of a stripping element, for which the at least one separating surface and the stripping element are moved relative to one another. The separating surface here is preferably moved with respect to a stationary stripping element. However, the relative movement can also be the other way round.

If the at least one stripping element comprises at least one exit opening, particularly an exit slot, from which a fluid, particularly compressed air, can exit, it is possible to avoid direct contact between the stripping element and the separating surface. This at least delays the contamination of the stripping element which increases over time.

The unladen separating agent is applied particularly advantageously in that the at least one separating surface is moved into a dip bath filled with separating agent and back out of this. Here, the separating agent is preferably at a temperature at which its viscosity is lower than it is at the operating temperature.

The separating agent can alternatively be sprayed or squirted onto the at least one separating surface.

The operating period can be approximately 2 hours, approximately 4 hours, approximately 6 hours, approximately 8 hours, approximately 10 hours or approximately 12 hours. When the separating agent is less laden with overspray, a longer operating period of up to several days is also possible as long as the insulating effect of the overspray does not influence the formation of the field lines in such a way that proper operation of the separating device is no longer possible. The corona current here is an indicator for the loading of the separating surface with overspray. The insulating effect of the overspray adhering to the separating agent causes the corona current to reduce as the thickness of the overspray layer increases. The corona current limit is generally determined empirically and is normally several milliamperes per high voltage electrode.

In a device of the type mentioned at the outset, the object mentioned above may be achieved in that c) an electrically conductive material or material mix is applied to the at least one separating surface as a separating agent and has a wax-like consistency at the operating temperature of the device.

The statements regarding the method above apply to the separating agent.

The device advantageously comprises a separating-agent renewal device by means of which separating agent with separated solids which is present on the at least one separating surface can be removed and/or unladen separating agent can be applied to the at least one separating surface.

It is favourable here if the separating-agent renewal device comprises at least one stripping element which can be moved relative to the at least one separating surface. This means that either the stripping element can be moved with respect to the stationary separating surface or the separating surface can be moved with respect to the stationary stripping element.

It is advantageous here if the at least one stripping element is coupled to a linear chain drive.

The stripping effect is advantageously increased if holding means are provided by means of which the at least one stripping element can be held at least temporarily in contact with the at least one separating surface.

It has proven favourable here if the holding means comprise a magnet, particularly an electromagnet.

It is particularly advantageous if the separating-agent renewal device comprises a dip bath filled with separating agent and a conveyor device by means of which the at least one separating surface can be moved into the dip bath and back out of this.

The separating-agent renewal device can alternatively comprise a nozzle device by means of which the separating agent can be sprayed or squirted onto the at least one separating surface.

It is favourable if the at least one separating surface is the outer face of a plate-shaped separating element. A separating element of this type is easy to handle and provides large separating surfaces in relation to its volume.

Effective separation can be achieved if the electrode device has a corona portion and a field portion, with the corona portion being arranged upstream of the field portion in the flow direction of the overspray-laden booth air.

In the system mentioned at the outset, the object described above may be achieved in that c) the electrostatic separating device is constructed according to one of the embodiments disclosed herein.

The system according to the invention therefore comprises a separating device having one or more of the features mentioned in relation to the device. The advantages which can be achieved thereby correspond to the advantages explained above with regard to the method and the device.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawings, which show.

DETAILED DESCRIPTION OF THE PRESENT INVENTION

Figure 1:
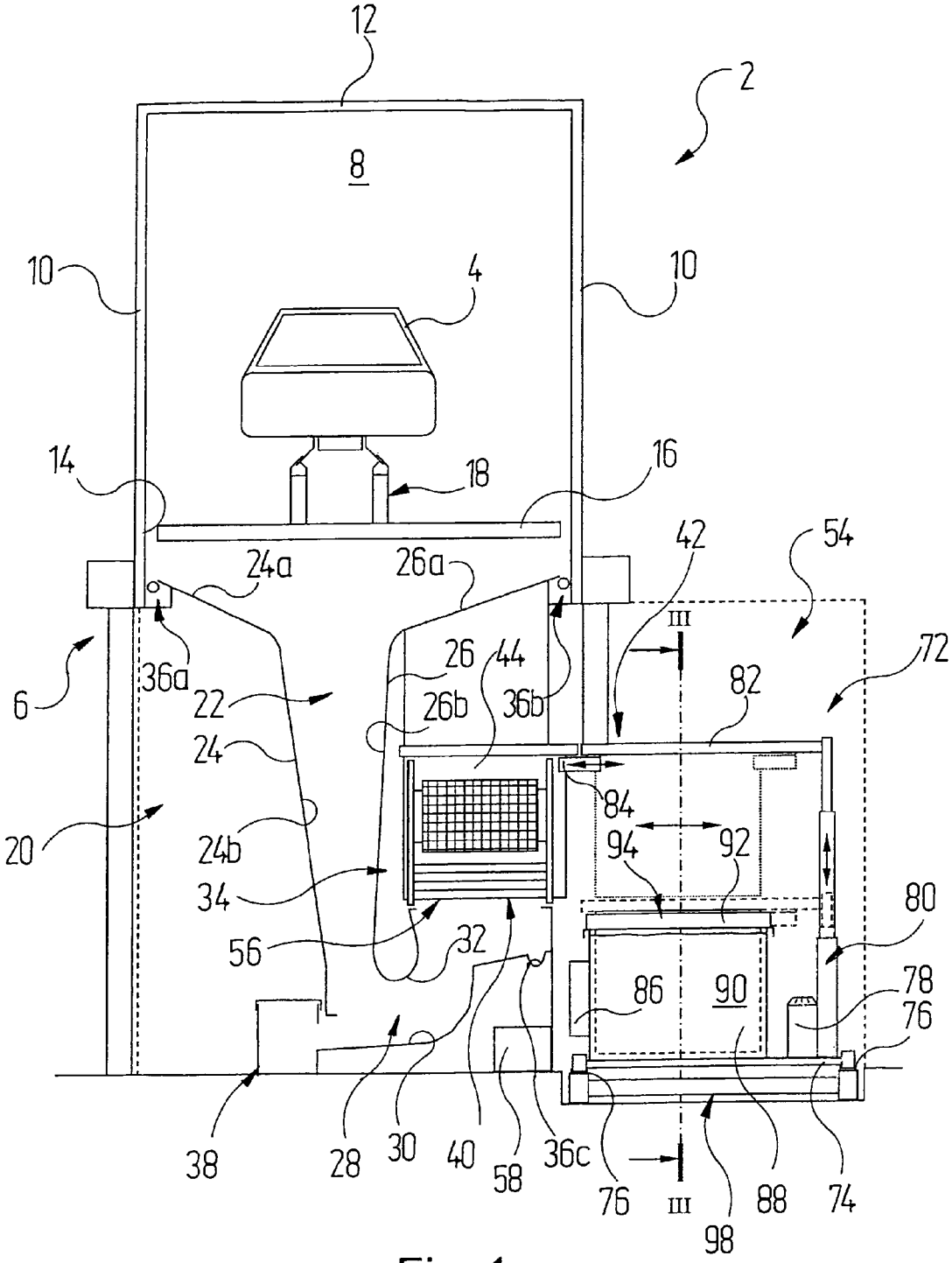
FIG. 1 a paint booth of a surface treatment system with a first exemplary embodiment of an overspray separating device in a front view.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
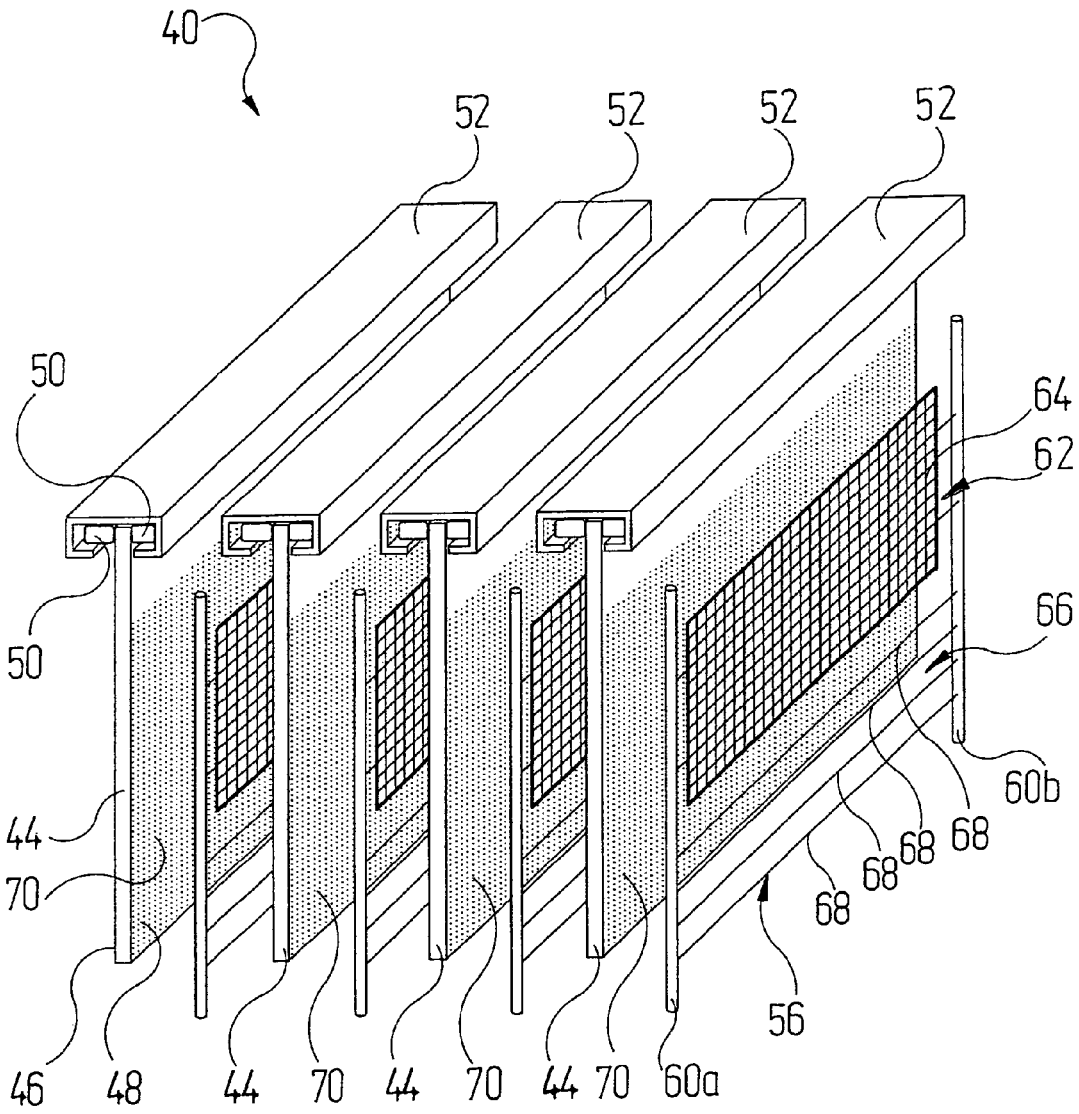
FIG. 2 a perspective view of four separating units and four electrode devices of the separating device of FIG. 1.
Figure 3:
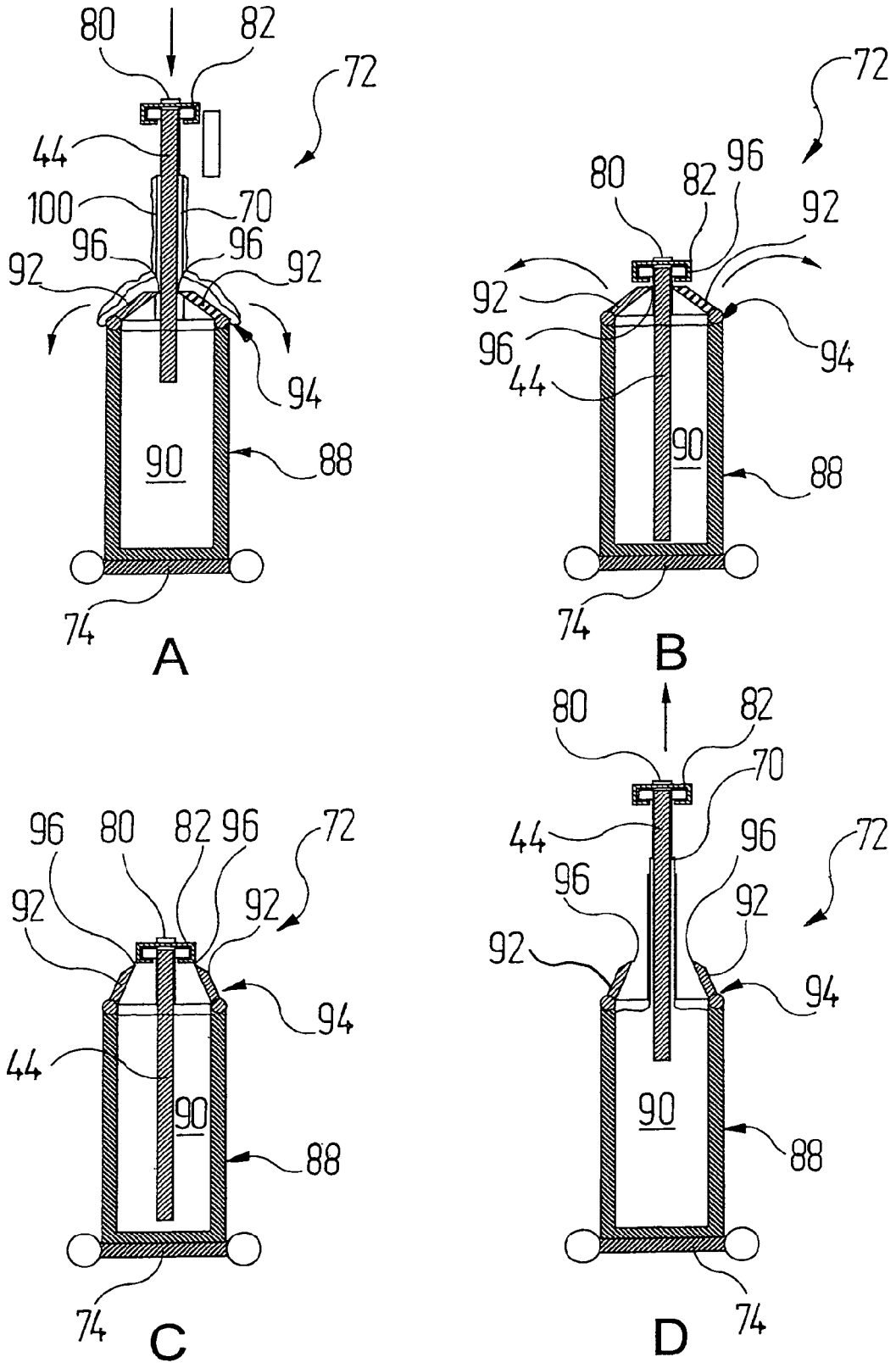
FIGS. 3A to 3D sections through a separating-agent renewal device in different operating phases along the section line III-III in FIG. 1.

Reference is firstly made to FIGS. 1 to 3. In these, 2 denotes a paint booth, as a whole, of a surface treatment system in which vehicle bodies 4 are painted after they have been cleaned and degreased, for example, in pre-treatment stations (not shown specifically) arranged upstream in the paint booth 2. The paint booth 2 rests on a steel structure 6 as is known per se.

The paint booth 2 comprises a paint tunnel 8, which is arranged at the top and is delimited by vertical side walls 10 and a horizontal booth ceiling 12, but is open at the end faces and towards the bottom such that overspray-laden booth exhaust air can flow downwards. The booth ceiling 12 is constructed in conventional manner as a lower delimitation of an air supply chamber (not illustrated) with a filter cover.

At the height of the lower opening 14 of the paint tunnel 8, which is flanked by the lower edges of the side walls 10, a steel structure 16 is arranged which supports a conveyor system 18 which is known per se and is not explained in further detail here. This can be used to transport vehicle bodies 4 to be painted from the entry side of the paint tunnel 8 to its exit side. Application devices (not shown specifically), by means of which the vehicle bodies 4 can be acted upon by paint in a manner known per se, are located inside the paint tunnel 8. The lower opening 14 of the paint tunnel 8 is covered by an accessible grating (not shown specifically).

A system region 20 in which the overspray particles which are entrained by the booth air are separated from the booth air is located below the paint booth 2. The system region 20 is delimited by a housing which is not provided with a specific reference numeral and is merely indicated as a dashed line in FIG. 1.

The system region 20 comprises a flow region 22 which is open at the top towards the paint booth 2 and is produced by two air deflectors 24 and 26. The left air deflector in FIG. 1 comprises a portion 24*a* which, from the outside in, has an initially moderate downward incline and merges into a portion 24*b* with a steep downward slope. The right air deflector 26 in FIG. 1 correspondingly has a portion 26*a* with a relatively slight downward incline and a steep portion 26*b*.

The air deflectors 24 and 26 lead downwards into a deflection region 28 in which a lower deflector 30 and a curved portion 32 continuing on from the air deflector 26 ensure that the booth air flowing from top to bottom flows in a direction from bottom to top through a separating chamber 34 arranged on the right in FIG. 1, next to the first flow region 22.

From distribution channels 36*a*, 36*b* mounted laterally adjacent to the air deflectors 24 and 26, a separating fluid can flow onto the air deflectors 24 and 26 and downwards in a substantially cohesive layer along their outer surface facing the paint booth 2. The separating fluid takes up some of the overspray entrained by the booth air whilst the booth air flows downwards from the paint booth 2 to the deflection region 28.

The overspray-laden separating fluid flows over the lower deflector 30 into a collecting tank 38 arranged on that side of the air deflector 24 which is remote from the separating chamber 34. From there, the separating fluid can be supplied to a cleaning and treatment process in which it is freed of the paint overspray in a manner known per se. The separating fluid can then be circulated back to the distribution channels 36.

A separating unit 40 of an electrostatically operating separating device 42 is arranged in the separating chamber 34. After the booth air has flowed through the separating unit 40, it is conveyed from above the separating unit 40 to an air-conditioning device (not shown) by means of which the cleaned air is brought back to the correct temperature and humidity so that it can again be conducted to the air supply chamber above the paint booth 2 where it is mixed with unused fresh air if required. On the side remote from the collecting tank 38, a third distribution channel 36*c*, from which separating fluid flows over that part of the lower deflector 30 which extends below the separating unit 40, is provided in the lower deflector 30.

The separating unit 40 comprises a plurality of rectangular separating plates 44 (of which four are shown in FIG. 2) arranged in succession in the longitudinal direction of the separating chamber 34. The respective opposing outer faces of the separating plate 44 form separating surfaces 46 and 48 of which only those of the separating plate 44 shown on the far left are provided with reference numerals in FIG. 2.

At its upper edge, the separating plate 44 supports a plurality of rollers 50 on each side, of which one can be seen on each side only in FIG. 2 and likewise only the rollers of the separating plate 44 shown on the far left in the Figure have reference numerals. For each separating plate 44, the separating unit 40 comprises a respective guide rail 52 constructed as a profile with a C-shaped cross-section. The guide rails 52 are arranged horizontally and such that the opening of the "C" points downwards. The separating plates 44 run with their rollers 50 in a respective guide rail 52 and can be moved to the right in FIG. 1 out of the separating chamber 34 and into a separating-agent renewal region 54 (cf. FIG. 1). In their operating position, the separating plates 44 are arranged in their associated guide rail 52 in the separating chamber 34 and are locked therein.

In the separating unit 40, the guide rails 52 are arranged parallel next to one another in such a way that a respective spacing remains between two adjacent separating plates 44 which is sufficient to enable two adjacent separating plates 44 to receive a respective electrode device 56 between them. Of these, only the electrode device shown on the far right in FIG. 2 is provided with a reference numeral.

Each electrode device 56 is connected to a terminal of a high voltage source 58 associated therewith, of which only one is indicated schematically in FIG. 1. The separating plates 44 are at ground potential by way of the other terminal of the high voltage source.

In a modification, all the electrode devices 56 can also be supplied by a single common high voltage source.

Each electrode device 56 comprises two linear mutually parallel-extending electrode strips 60*a*, 60*b*. These hold a grid electrode 64 in a field portion 62 of the electrode device 56, whereof the edges extending between the electrode strips 60*a*, 60*b* are perpendicular thereto. In a corona portion 66 of the electrode device 56, the electrode strips 60*a*, 60*b* hold a plurality of corona wires 68 acting as a discharge electrode. The corona wires 68 extend perpendicularly to the electrode strips 60*a*, 60*b* in a plane specified thereby and are arranged at equal spacings from one another.

The number of corona wires 68 of the electrode device 56 and their spacing from one another can vary depending on the separation behaviour of the overspray particles. In the present exemplary embodiment, four corona wires 68 are provided per electrode device 56.

As shown in FIGS. 1 and 2, the electrode devices 56 as a whole have an extent which corresponds approximately to the extent of the separating plates 44 of the separating unit 40.

Each separating plate is provided on both separating surfaces 46 and 48 with a respective layer 70 of an electrically conductive wax-like material or material mix which acts as a separating agent and prevents separated overspray from depositing on the separating surfaces 46, 48 of the separating plates 44. The layers 70 are each between 0.2 mm and 2 mm thick. In practice, a 1 mm thickness of the layers 70 has proven expedient.

The term wax-like material is used here to refer to a material which has a plastic consistency at the operating temperature of the separating device 38. The separating agent is preferably kneadable or spreadable at the operating temperature. The wax-like material should therefore be comparatively pliable at the operating temperature of the separating device 38, yet substantially dimensionally stable and it should only exhibit a very limited flow behaviour, if at all. The operating temperature of the separating device 38 is generally below 28° C., although it can also be higher depending on the application.

A material is selected here whereof the viscosity is moreover reduced at temperatures above the operating temperature and is less at a temperature above the operating temperature than it is at the operating temperature.

In practice, for example, greases, particularly paraffins, soaps, waxes and gels, have proven useful as separating agents. As a paraffin, it was possible to achieve good results with Vaseline. Waxes can be produced both from natural sources and also synthetically and can be defined according to several mechanico-physical properties. The term wax is used in particular here to refer to a material which is kneadable at the operating temperature of the separating device 40, melts without decomposing at higher temperatures and is less viscous, i.e. slightly liquid, slightly above the melting point.

The conductivity of the separating agent is essentially such that a charge can flow and is preferably in the range of 50 to 5000 μS/cm, particularly 1000 to 3000 μS/cm. If required, the conductivity of the separating agent can be adjusted with added substances, for example salts.

In addition to the separating unit 40, the separating device 42 has a separating-agent renewal device 72 which is arranged in the separating-agent renewal region 54 (see FIG. 1).

The separating-agent renewal device 72 comprises a carriage 74 which can be moved on a rail pair 76 which extends in the longitudinal direction of the paint booth 2 so that the carriage 74 can be moved along the entire separating unit 40. The carriage 74 is driven by means of a motor/control unit 78. The motor/control unit 78 at the same time serves to operate a telescopic device 80 which is carried along by the carriage 74 and by means of which a horizontally extending rail profile 82 can be raised or lowered in the vertical direction. This is indicated in FIG. 1 by a corresponding double-headed arrow. The rail profile 82 corresponds in cross-section to the guide rails 52 of the separating unit 40. The telescopic device 80 is arranged on that side of the carriage 74 which is remote from the separating unit 40.

A clamping shoe 84 is movably guided in the rail profile 82, as shown by a double-headed arrow in FIG. 1. The clamping shoe 84 is likewise controlled by the motor/control unit 78. The carriage 74 moreover supports a dip bath 88 which can be heated by means of a heating device 86 and is filled with separating agent 90. The separating agent 90 in the dip bath 88 is heated to a temperature at which it has a viscosity which enables the separating plates 44 to be coated by being dipped in the separating agent 90. On its edges which extend horizontally and perpendicularly to the movement direction of the carriage 74, the dip bath 88 supports stripping elements 92 of a stripping device 94 (shown in section in FIG. 3) which extend longitudinally to the edges. The stripping elements 92 are pivotably mounted at the respective edge of the dip bath 88 and can be moved with their upper stripping edges 96 towards and away from one another between a stripping position and a release position. In their stripping position, a spacing is maintained between the stripping edges 96 which corresponds to the thickness of the separating plates 44.

Arranged below the rail pair 76, there is a revolving continuous conveyor belt 98 which likewise extends in the longitudinal direction of the paint booth 2 and leads to a collecting region (not shown specifically).

The paint booth 2 explained above now operates as follows:

When painting the vehicle bodies 4 in the paint tunnel 8, the booth air located there is laden with paint overspray particles. These can still be liquid and/or tacky, or they can be more or less solid. The booth exhaust air which is laden with paint overspray flows through the lower opening 14 of the paint tunnel 8 into the first flow region 22 of the lower system region 20. This air is conducted there to the deflection region 28 by means of the air deflectors 24, 26, with some of the overspray already having been taken up by the separating fluid flowing down on the air deflectors 24, 26. The booth air is deflected through the deflection region 28 in the direction of the separating unit 40 of the separating device where it flows through between adjacent separating plates 44.

Corona discharges take place at the corona wires 68 of the electrode devices 56 in a manner known per se, which results in effective ionisation of the overspray particles in the booth exhaust air flowing past.

The ionised overspray particles pass over the separating plates 44 which are at ground potential and the grid electrodes 64 extending between them in the field portion 62 of the electrode devices 56. As a result of the electrical field produced between the grid electrode 64 and the separating plates 44, the ionised overspray particles separate on the separating-agent layer 70 on the separating plates 44 and, for the most part, remain adhered to the separating-agent layer 70.

Overspray which may have dropped downwards from the separating plates 44 is taken up by the separating fluid flowing over the lower deflector 30 and conducted to the collecting tank 38.

Most of the ionised overspray particles are already separated in the corona portion 66 of the electrode device 56 on the separating plates 44. The electrical field which is present between the corona wires 68 and the respective separating plate 44 of the separating unit 40 is, however, more inhomogeneous than the electrical field in the region of the grid electrode 64, which is why a more targeted separation of the ionised overspray particles takes place at the corresponding separating plate 44. As a result, the overspray particles which have passed over the corona portion 66 are effectively separated in the field portion 62.

As mentioned above, the air which is cleaned as it passes through the separating unit 40 is supplied back to the paint tunnel 8 after a certain conditioning.

For correct operation of the separating unit 40, it is necessary to ensure that a sufficiently strong electrical field can build up between the separating plates 44 and the electrode devices 56, which is only possible up to a certain layer thickness of the separated paint overspray on the separating surface since such a layer has an insulating effect. The strength of the insulating effect of the accumulated overspray layer can be determined by way of the current requirement of the separating unit 40 generating the corresponding corona current, which decreases over time.

Moreover, solid particles and binding-agent constituents from the separated overspray migrate from the surface of the separating-agent layers 70 into the separating agent. After a certain operating period, there is a risk that solid particles will migrate as far as the separating surfaces 46, 48 and deposit there, which would have a substantial adverse effect on the functional capability of the separating unit 40 and necessitate costly cleaning and maintenance.

Therefore, if the insulating effect of the separated overspray is too great and/or it is no longer possible to ensure perfect operation of the separating unit, the separating-agent layers 70 with overspray now adhering thereto are removed from the separating plates 44 and the separating surfaces 46, 48 of the separating plates 44 are provided with new, unused separating agent.

To this end, the rail profile 82 on the telescopic device 80 of the separating-agent renewal device 72 is brought into a position in which it is aligned with the guide rail 52 of the separating plate 44 to be cleaned. For this, the carriage 74 is moved into a corresponding position on the rail pair 76 on the one hand and the telescopic device 80 is extended accordingly on the other.

The clamping shoe 84 is moved forwards in the rail profile 82 in the direction of the separating plate 44 where it engages with this. The above-mentioned locking of the separating plate 44 in the guide rail 52 is released. The clamping shoe is now moved back again in the direction of the telescopic device 80, drawing the separating plate 44 with it. The spacing between the rail profile 82 and the corresponding guide rail 52 is small enough for the separating plate 44 to be able to move easily on its rollers 50 out of the guide rail 52 and into the rail profile 82.

The separating plate 44 is moved into a position in the rail profile 82 in which it is above the dip bath 88 with the stripping device 94. This position of the separating plate 44 is shown by dotted lines in FIG. 1.

The stripping elements 92 of the stripping device 94 are brought into their stripping position and the separating plate 44 is dipped into the heated separating agent 90 in the dip bath 88 by means of the telescopic device 80. This is shown in FIG. 3A.

As can be seen here, on its way downwards, the separating plate 44 moves past the stripping elements 92. As a result, the separating-agent layers 70 which are adhering to the separating plate 44 with the overspray 100 separated on them are stripped from the separating plate 44 and fall downwards onto the conveyor belt 98, which is not shown in FIGS. 3A to 3D.

As mentioned above, the separating agent which has fallen with the overspray from the separating plate 44 is conveyed by the conveyor belt 98 to a collecting region. From there, it is supplied for treatment. To this end, the material mix can be heated, for example, causing the separating agent to become liquid. The resultant material mix of liquefied separating agent and overspray can then be removed, for example by suitable filters.

The separating-agent/overspray mixture can alternatively be centrifuged, possibly under pressure, and the resultant phases can be separated from one another after this. The separating agent which is cleaned in this way can then be kept flowable by a corresponding heat supply and guided back to the dip bath 88 in a circuit. The filtered-off overspray can in turn be supplied for further treatment if required or for disposal as is known per se.

In its lowest position, which is illustrated by dashed lines in FIG. 1, the separating plate 44 is now freed of the used separating-agent layer 70 and overspray 100 adhering thereto and is dipped into the separating agent 90 in the dip bath 88.

The stripping elements 92 are now brought into their release position (see FIGS. 3B and 3C).

The telescopic device 80 is now used to raise the separating plate 44 again and move it out of the separating agent 90 (see FIG. 3D). Separating agent adhering to the separating plate 44 cools quickly in the environment, which is cooler than the dip bath, so that it is at its working viscosity when it exits the separating-agent bath and adheres as a new separating-agent layer 70 to the separating plate 44 when this latter is moved completely out of the dip bath 88.

The separating plate 44, which is now provided with a new and unladen separating-agent layer 70, is then moved back into that guide rail 52 of the separating unit 40 which is associated therewith, in that the telescopic device 80 is extended accordingly and the clamping shoe 84 is moved in the direction of the separating unit 40. When the separating plate 44 assumes its operating position of its guide rail 52, it is locked there, whereupon the clamping shoe 84 releases the separating plate 44. The procedure can then be repeated with another separating plate 44 which has to be freed of the separating agent with overspray adhering to it.

In a modification, the separating-agent renewal device comprises a plurality of dip baths 88 and a plurality of telescopic devices 80 with a rail profile 82, so that a plurality of separating plates 44 can be treated at the same time.

Figure 4:
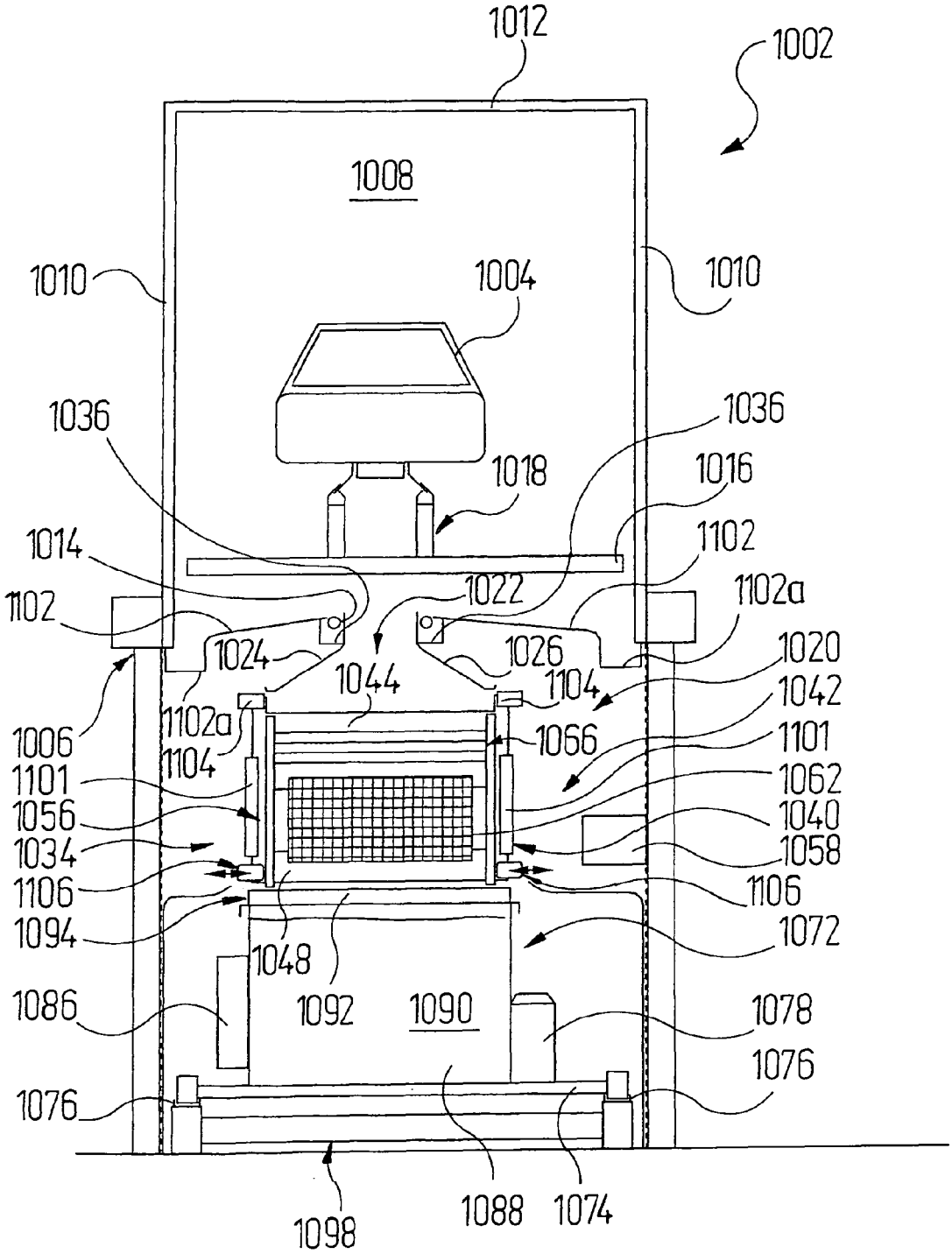
FIG. 4 a view corresponding to FIG. 1 of a paint booth with a modified overspray separating device, as a second exemplary embodiment.

As a second exemplary embodiment, FIG. 4 shows a paint booth 1002 with which a separating device 1042 is associated. Components which correspond to those of FIGS. 1 to 3 have the same reference numerals plus 1000.

Contrary to the paint booth 2, there is no deflection region in the lower system region 1020. Instead, the separating chamber 1034 in which the separating unit 1040 is arranged adjoins the flow region 1022 provided by the air deflectors 1024 and 1026. The lower booth opening 1014 extends here between the upper ends of the air deflectors 1024 and 1026, which then diverge downwards to the separating chamber 1034.

The lower booth opening 1014 is flanked by separating sheets 1102 which slope moderately downwards in an outward direction and are shaped on the outside to form a collecting channel 1102*a*. A separating fluid can be supplied to the separating sheets 1102 from distribution channels 1036 which are arranged adjacent to the air deflectors 1024 and 1026.

In this exemplary embodiment, the booth air flows from top to bottom through the separating unit 1040, which is why the electrode devices 1056 are arranged accordingly in such a way that the corona portion 1066 is at the top and the field portion 1062 is at the bottom.

The separating plates 1044 are not guided in horizontal guide rails, but are detachably suspended in holding units

1104 which are arranged a short distance below the lower ends of the air deflectors 1024 and 1026. The holding units 1104 can be controlled in such a way that they optionally hold or release the separating plates 1044.

Contrary to the separating-agent renewal device 72 according to FIGS. 1 and 3, the separating-agent renewal device 1072 does not comprise a telescopic device. Instead, driven clamping roller pairs 1106, which are rotatable about horizontal rotational axes, are provided to lower and raise the separating plates 1044. These clamp the separating plates 1044 in the edge region in a conveying position on the opposing separating surfaces 1046, 1048 and can lower or raise them by rotating in the corresponding direction. Lateral guide rails 1101 ensure that the separating plates 1044 are guided in the lateral direction.

It is alternatively possible, for example, for the separating plates 1044 to be additionally grooved in the edge region or provided with cutouts and, instead of the clamping roller pair 1106, to use pinions engaging in the grooved portions or cutouts so that the separating plate 1044 is conveyed in a manner similar to that of a film. In this case, it can also be ensured that the separating plate 1044 is guided in the lateral direction without the vertical guide rails 1101.

So that there is no interference from the clamping roller pair 1106 when the carriage 1074 is moved in the longitudinal direction of the paint booth 1002, they can moreover be moved in the horizontal direction laterally alongside the separating unit 1040.

Therefore, if a separating plate 1004 needs to be cleaned, the clamping roller pair 1106 are moved into their conveying position and the separating plate 1044 is released by the holding units 1104 and moved downwards into the dip bath 1088 through a corresponding rotation of the clamping roller pair 1106. The stripping elements 1092 assume their stripping position here.

This aside, the separating plates 1044 are cleaned and newly coated with separating agent in a manner analogous to the procedure explained above with reference to FIGS. 1 to 3.

Figure 5:
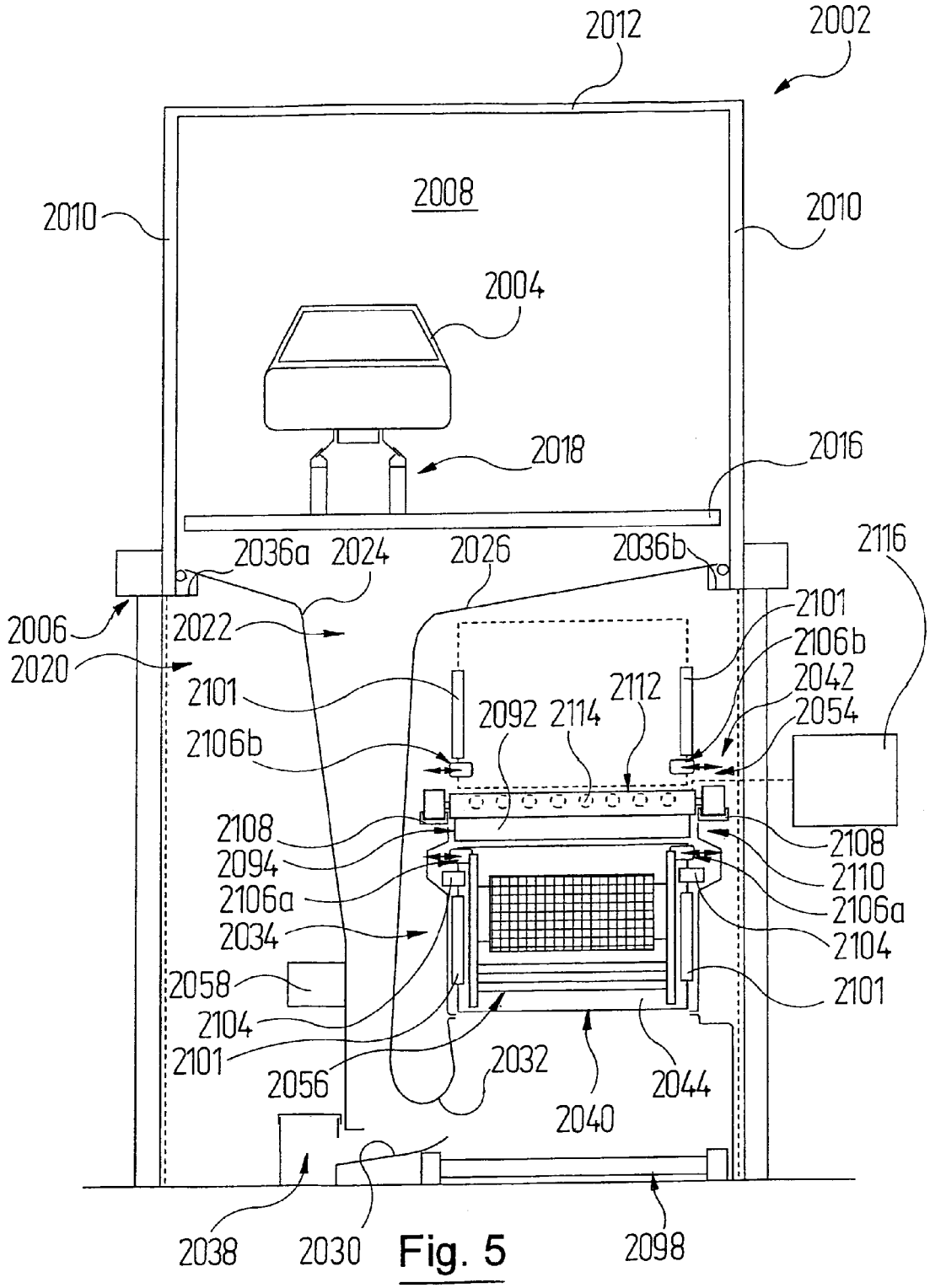
FIG. 5 a view corresponding to FIGS. 1 and 4 of a paint booth with an again-modified overspray separating device, as a third exemplary embodiment.
Figure 6:
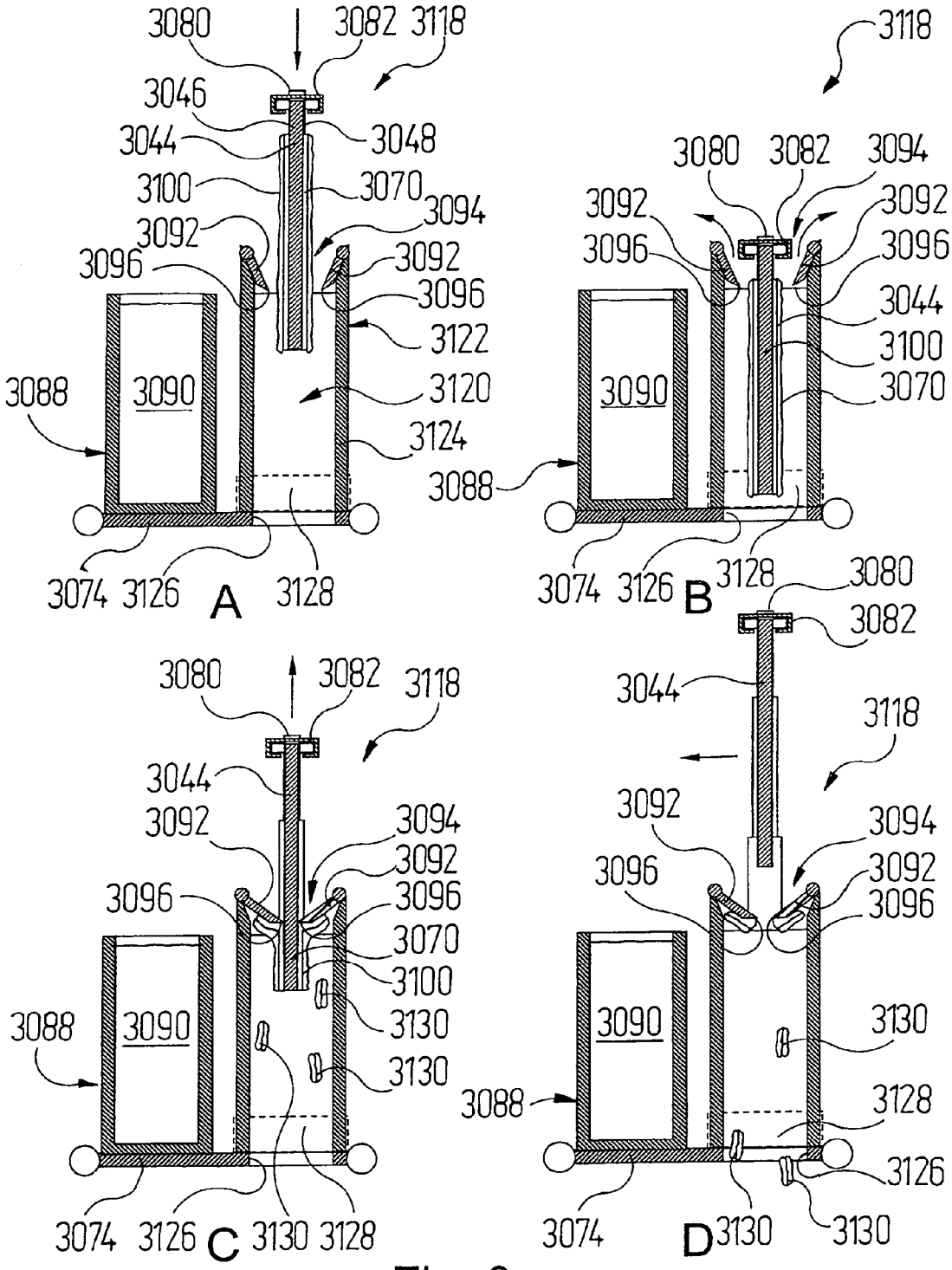
FIGS. 6A to 6D and FIGS. 7A to 7C sections through a modified separating-agent renewal device in different operating phases, with the sections corresponding to those of FIGS. 3A to 3D.
Figure 7:
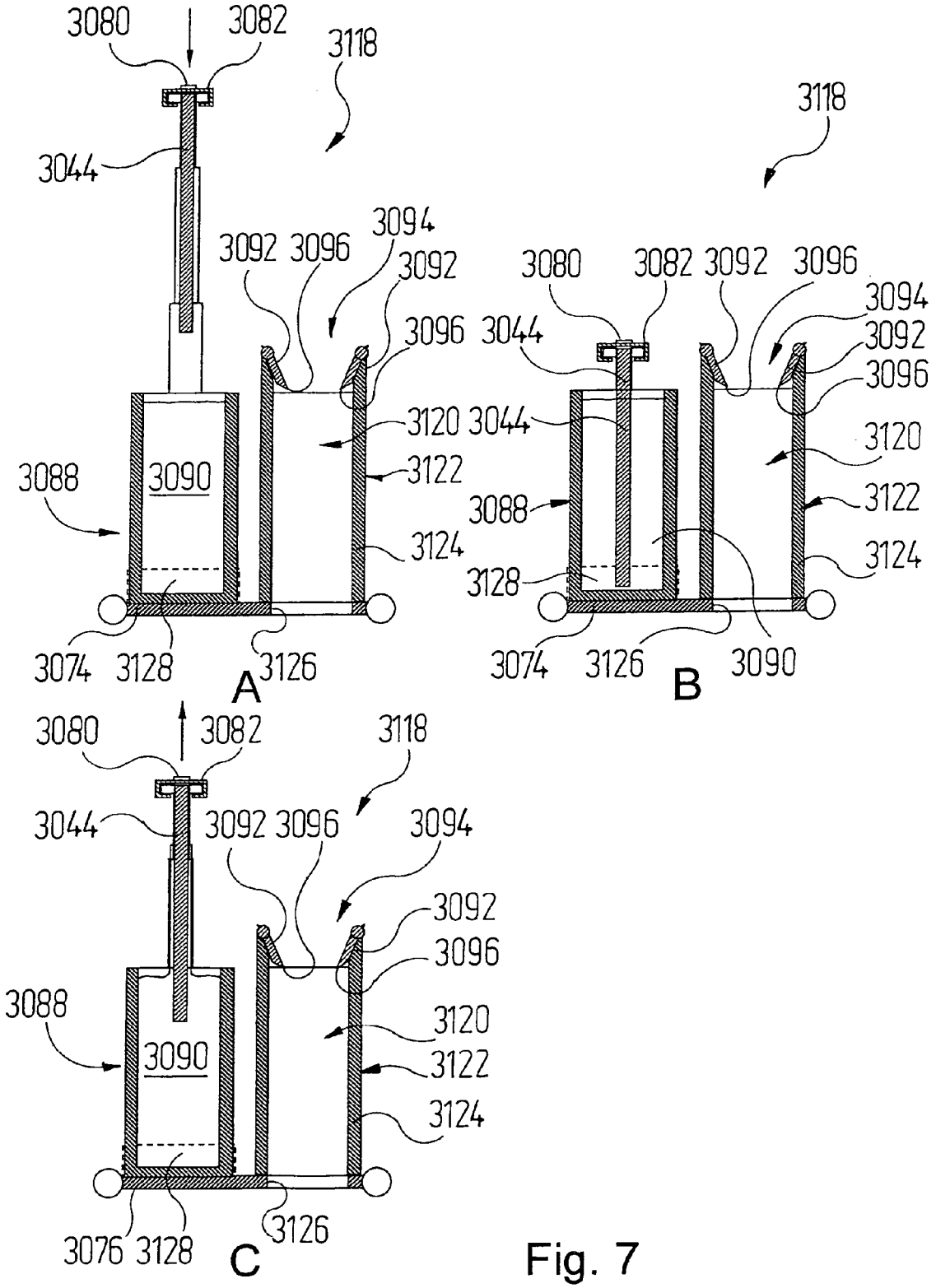

As a third exemplary embodiment, FIG. 5 shows a paint booth 2002 with which a separating device 2042 is associated. Components which correspond to those of FIGS. 1 to 3 have the same reference numerals plus 2000.

The basic structure corresponds to that of the paint booth 2 according to FIG. 1. However, contrary to this, the separating-agent renewal region 2054 is arranged above the separating unit 2040. For this purpose, a respective horizontal rail 2108 is provided on the right and left hand sides above the separating unit 2040 and supports a modified separating-agent renewal device 2110 such that it is movable in the longitudinal direction of the paint booth 2002.

The separating-agent renewal device 2110 comprises a downwardly pointing stripping device 2094 with stripping elements 2092 of which only one can be seen in FIG. 5. Their stripping edges (not shown in FIG. 5) point downwards. A nozzle arrangement 2112 is moreover provided which comprises a plurality of nozzles 2114 which are illustrated as a dashed circle and are arranged on both sides of a through-slot through which a separating plate 2044 can be guided. Only one of the nozzles is provided with a reference numeral in FIG. 5.

For raising and lowering a separating plate 2044, two clamping roller pairs 2106*a* arranged below the stripping device 2094 and two clamping roller pairs 2106*b* arranged above the nozzle device 2112 are provided so that a separating plate can be transferred from the lower clamping roller pairs 2106*a* to the upper clamping roller pairs 2106*b* and vice versa. Holding units 2104 are arranged below the lower clamping roller pairs 2016*a* here.

For raising and lowering a separating plate 2044 to be cleaned, the separating-agent renewal device 2110 is firstly moved into a position above the separating plate 2044 in question. The separating plate 2044 is then gripped by the lower clamping roller pairs 2106*a* and conveyed upwards after the holding units 2104 have released the separating plate 2044. The stripping elements 2092 assume their stripping position here so that separating agent with overspray adhering to it is stripped from the separating plate 2044 and falls down onto the conveyor belt 2098.

After the separating plate 2044 has been freed of separating agent, it is moved back downwards at which the nozzle arrangement 2112 is now activated. The nozzles 2114 are supplied from a heatable separating-agent reservoir 2116 and spray or squirt separating agent onto both separating surfaces 2046, 2048 of the separating plate 2044. If required, the nozzles 2114 can also be heated to keep the separating agent at a temperature at which it can be sprayed or squirted.

In a modification which is not shown specifically here, instead of the nozzle arrangement 2112 a roller arrangement or a doctor-blade arrangement is provided by means of which separating agent can be applied to the separating plate 2004 by a roller or a doctor blade.

In a corresponding roller arrangement, it is possible, for example, for a respective rotating roller which dips in each case into a separating-agent bath to be arranged on each side of the separating plate 2044. The separating plate 2044 is pushed through between these rotating rollers, with the rotating rollers being arranged such that the separating surfaces 2046 and 2048 are thereby uniformly wetted with separating agent.

In a corresponding doctor-blade arrangement, the separating agent is preferably applied to the separating surfaces 2046 and 2048 in paste-like form by means of a doctor blade.

The operating periods over which a separating plate 44, 1044, 2044 which has been freshly coated with separating agent can be used, and after which existing separating agent with separated solids is removed and unladen separating agent is applied to the separating plate 44, 1044, 2044, depend, among other things, on the behaviour of the overspray. In practice, operating periods of 2 hours, 4 hours, 6 hours, 8 hours, 10 hours and 12 hours or even several days have proven possible.

FIGS. 6A to 6D and 7A to 7C show a separating-agent renewal device 3118 as a modification of the separating-agent renewal device 72. In these, components which correspond to the components of the separating-agent renewal device 72 have the same reference numerals plus 3000, with the separating surfaces 3046 and 3048 of the separating plate 3044 shown only being provided with reference numerals in FIG. 6A.

In the separating-agent renewal device 3118, the dip bath 3088 and the stripping device 3094 are arranged in succession on the carriage 3074 as seen in the longitudinal direction of the paint booth 2. To this end, the carriage 3074 has correspondingly greater dimensions than the carriage 74 of the separating-agent renewal device 72.

The stripping device 3094 comprises a receiving region 3120 for separating agent and overspray, which is arranged below the stripping elements 3092 and is delimited by four side walls 3124 forming a protective box 3122 which is open at the top and bottom.

The carriage 3072 moreover has a passage 3126 which complements the internal cross-section of the protective box 3122.

The telescopic device 3080 rests on a positioning carriage 3128 which can be moved on the carriage 3074 parallel to its movement direction. The positioning carriage 3128 is only indicated schematically and by dashed lines in FIGS. 6 and 7.

In the separating-agent renewal device 3118, the separating plate 3044 is moved in the rail profile 3082 into a position in which it is above the protective box 3122 with the stripping device 3094. To this end, the positioning carriage 3128 is moved into a corresponding position on the carriage 3074.

The stripping elements 3092 of the stripping device 3094 are firstly in their release position. The telescopic device 3080 is used to move the separating plate 3044 downwards into the protective box 3122 between the stripping elements 3092 without the stripping elements 3092 coming into contact with the separating-agent layers 3070 or the overspray 3100 adhering thereto. This is shown in FIG. 6A.

When the separating plate 3044 assumes its lowest position (shown in FIG. 6B), the stripping elements 3092 are brought into their stripping position.

The separating plate 3044 is then moved back upwards by means of the telescopic device 3080 and, on its upward path, moves past the stripping elements 3092 which are now lying with their stripping edges 3096 against the separating plate 3044. The separating-agent layers 3070 adhering to the separating plate 3044 are thus stripped off of the separating plate 3044 with the overspray 3100 adhering to them and fall downwards through the protective box 3122 and the passage 3126 in the carriage 3074 onto the conveyor belt 98, 1098, 2098, which is not shown in FIGS. 6A to 6D. This is shown by material pieces 3130 (see FIGS. 6C and 6D).

The separating plate 3044 which is free of the used separating-agent layer 3070 and the overspray 3100 adhering thereto is now located in its highest position above the stripping device 3094 again.

The positioning carriage 3128 is then moved into a position such that the separating plate 3044 is located above the dip bath 3088 (see FIGS. 6D and 7A). The separating plate 3044 is firstly dipped into the dip bath 3088 containing the separating agent 3090 by means of the telescopic device 3080 (see FIG. 7B) and then moved back out of this (see FIG. 7C).

As already explained above, separating agent adhering to the separating plate 3044 cools quickly in the environment, which is cooler than the dip bath, so that it is at its working viscosity when it exits the separating-agent bath and adheres as a new separating-agent layer 3070 to the separating plate 3044 when this latter has been moved completely out of the dip bath 3088.

Figure 8:
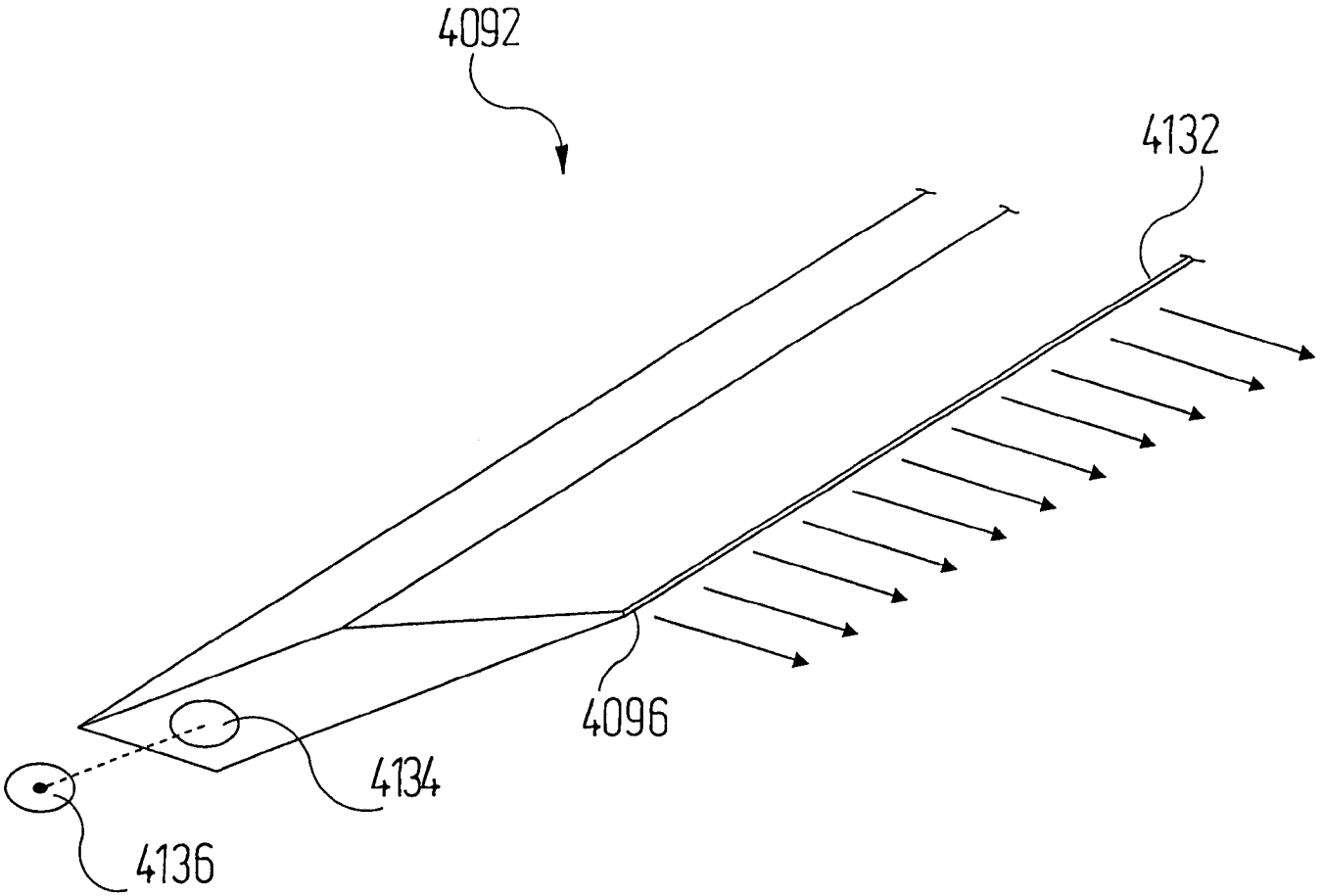
FIG. 8 a perspective view of a section of a stripping element of a stripping device on an enlarged scale, said stripping element being constructed as a compressed air nozzle.

FIG. 8 shows a stripping element 4092 as a modification, which can be used as an alternative to the stripping devices 94, 1094, 2094 and 3094 shown in FIGS. 1 and 3 to 7.

The stripping element 4092 comprises an air outlet slot 4132 extending along its stripping edge 4096. This air outlet slot is in communication with a compressed air connection 4134 by way of which the stripping element 4092 can be supplied with compressed air from a compressed air source 4136, which is then discharged by way of the air outlet slot 4132. This is shown by the arrows in FIG. 8. The compressed air can optionally be heated to a temperature such that the separating agent is more liquid when it comes into contact with this heated compressed air.

If stripping elements 4092 of this type are used for stripping the overspray-laden separating-agent layers, their stripping edges 4096 no longer have to come into mechanical contact with the respective separating plate 44, 1044, 2044 or 3044. Instead, a spacing can remain between the respective stripping edge 4096 with the air outlet slot 4132 and the separating plate 44, 1044, 2044 or 3044. The overspray-laden separating-agent layers are, as it were, blown away from the separating plate 44, 1044, 2044 or 3044 by the air stream generated. The remaining spacing enables the contamination of the stripping elements 4092 to be reduced by comparison with the stripping elements 92, 1092, 2092 or 3092 which come directly into contact with the separating agent and the overspray.

A further option for removing the overspray-laden separating agent layers from the separating plates 44, 1044, 2044 or 3044 consists in converting the separating agent by heating into a liquid state in which it flows off the respective separating plate 44, 1044, 2044 or 3044 together with the overspray. This can be carried out for example using heating elements or exposure to IR radiation instead of, or in addition to, the stripping elements 92, 1092, 2092, 3092 or 4092. Inductive heating of the separating plates 44, 1044, 2044 or 3044 is also conceivable.

Figure 9:
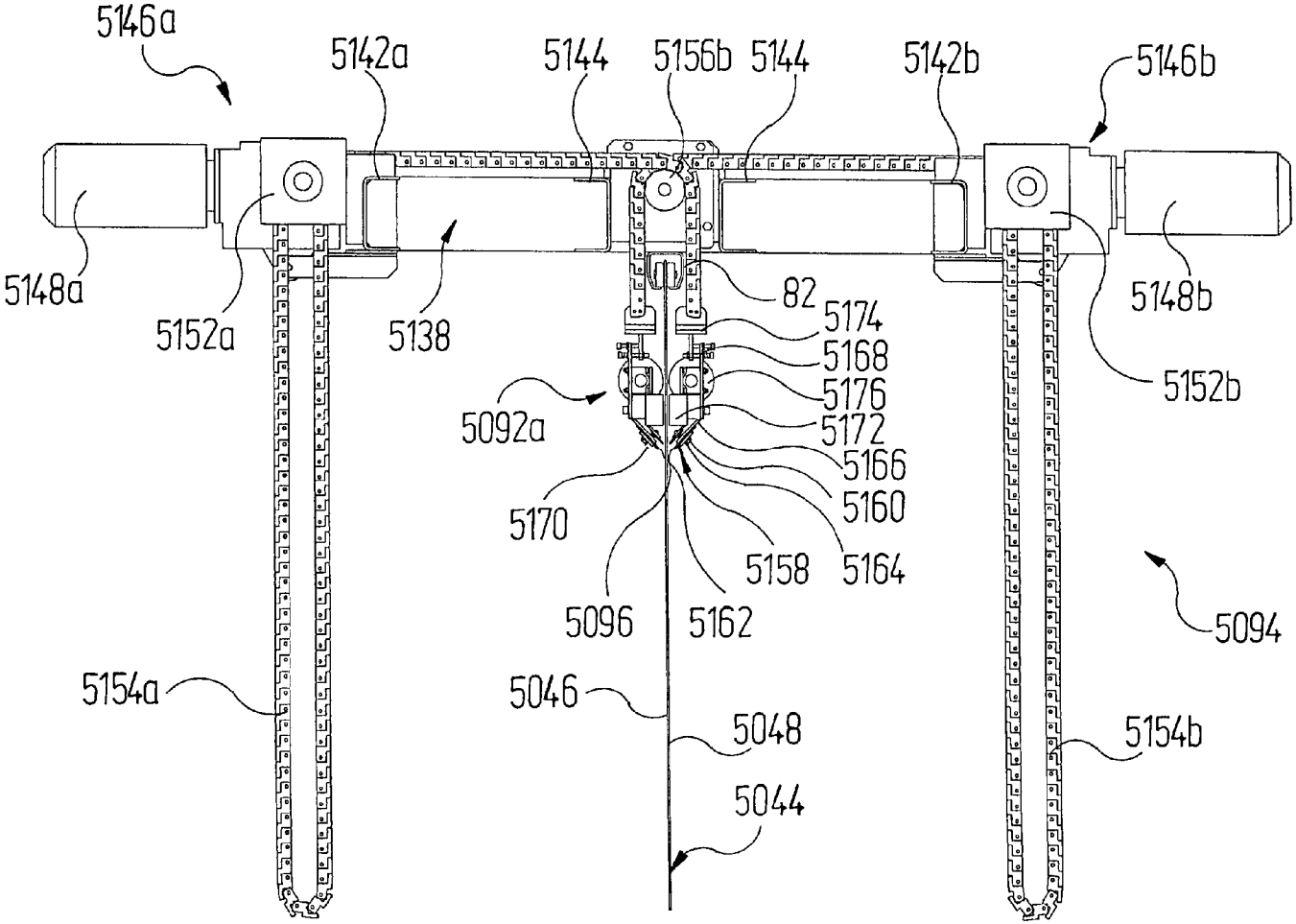
FIG. 9 a section of a stripping device along the section line IX-IX in FIG. 10.
Figure 10:
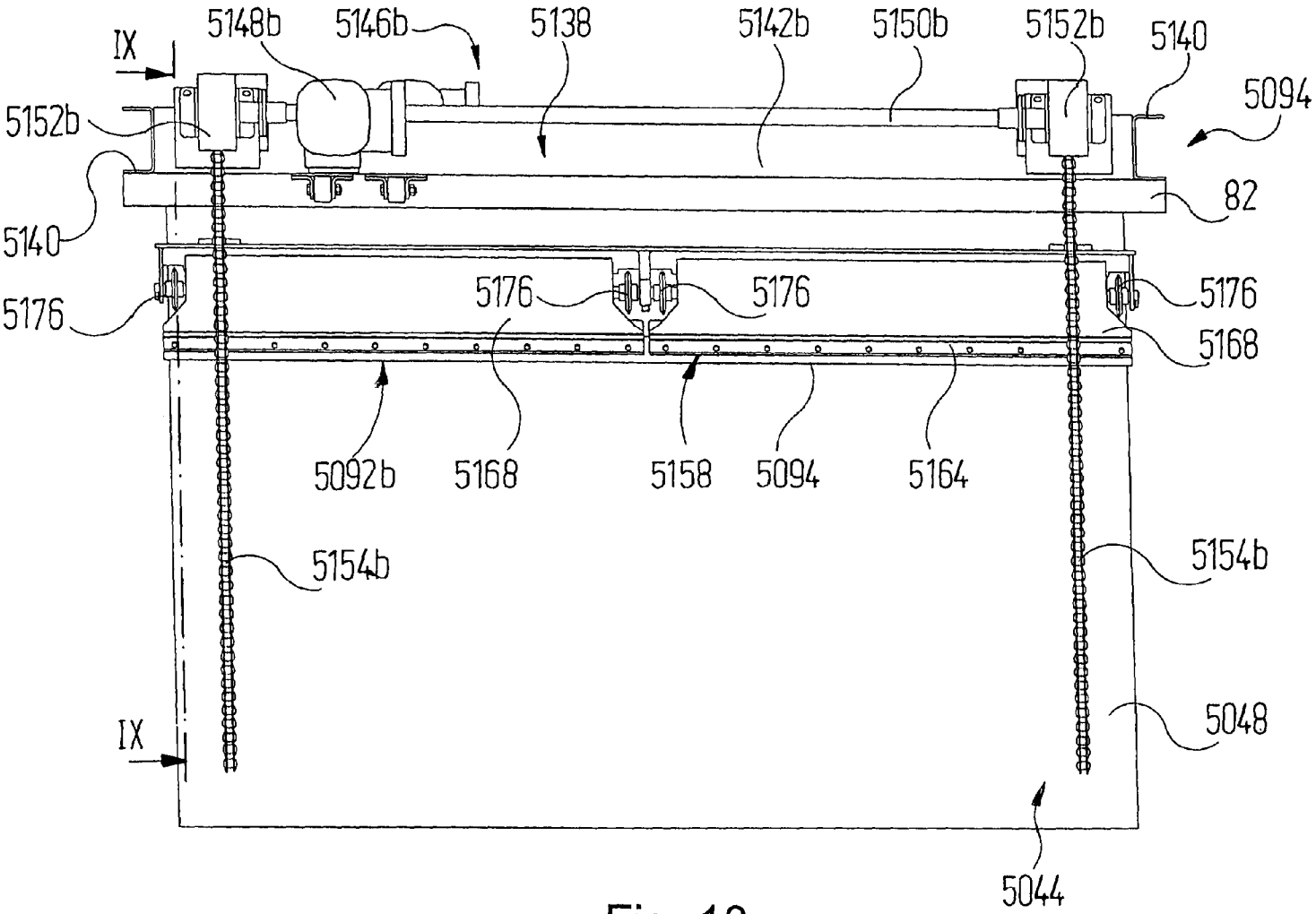
FIG. 10 a side view of the stripping device of FIG. 9.
Figure 11:
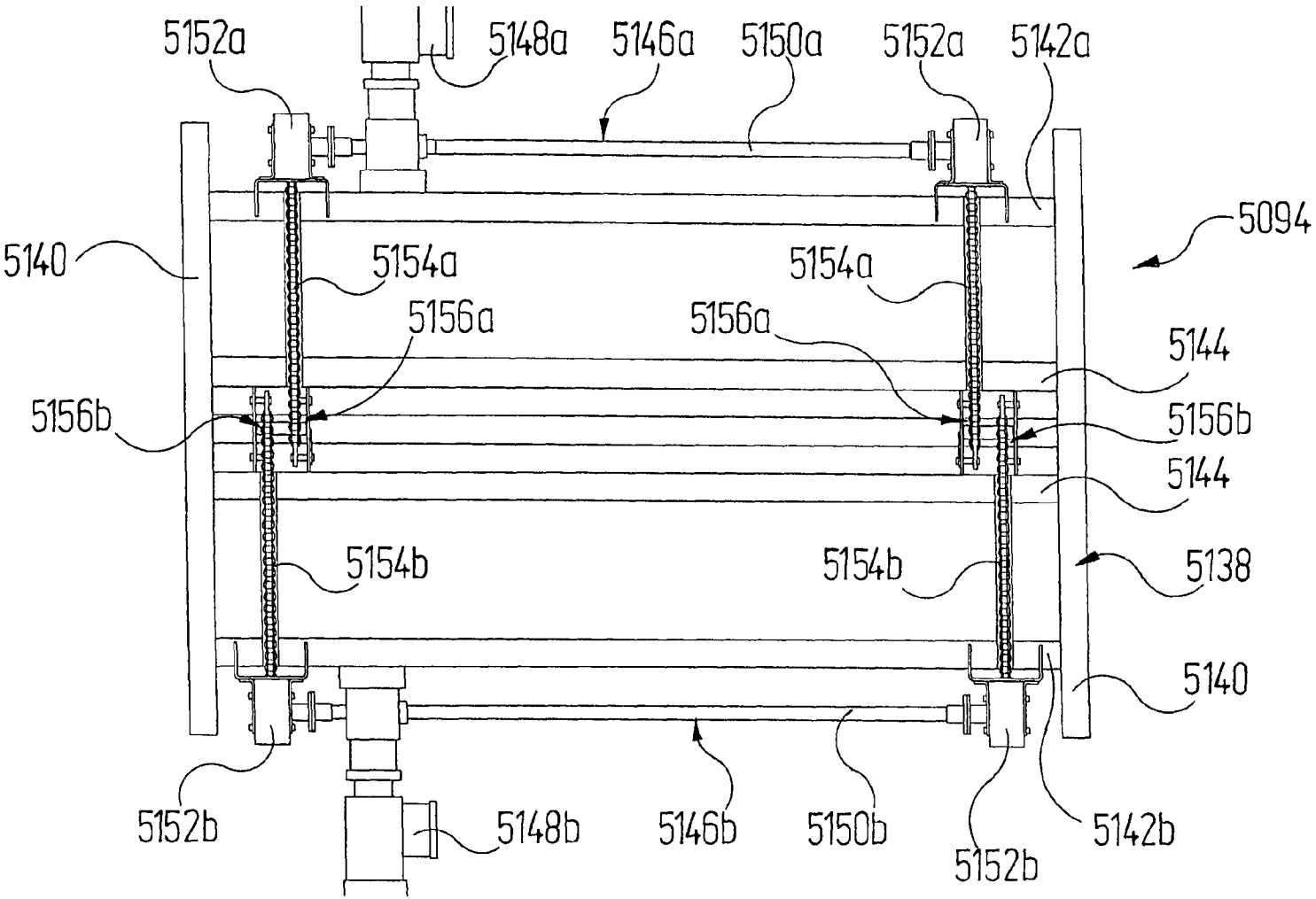
FIG. 11 a plan view of the stripping device of FIGS. 9 and 10.

In FIGS. 9 to 11, a further exemplary embodiment of a stripping device is denoted by 5094. Whereas, in the stripping devices 94, 1094, 2094 and 3094 described above, the separating plates 44, 1044, 2044 and 3044 are each moved with respect to the stationary stripping elements 92, 1092, 2092 and 3092, in the stripping device 5094 the associated stripping elements 5092*a*, 5092*b* are moved from top to bottom with respect to the separating plate 5044 to be cleaned.

The stripping device 5094 is explained below with reference to the separating-agent renewal device 72 according to FIGS. 1 to 3. However, it can also be used accordingly in the separating-agent renewal devices 1072, 2110 or 3118 instead of the stripping devices 1094, 2094 and 3094. For the sake of clarity, only the rail profile 82 of the separating-agent renewal device 72 is shown in FIGS. 9 and 10.

The stripping device 5094 comprises a supporting frame 5138, which is carried along by the carriage 74 and is arranged stationary above the highest position of the rail profile 82.

The supporting frame 5138 is symmetrical to a vertical plane which extends through the longitudinal axis of the rail profile 82 in the assembled state of the supporting frame 5138. The supporting frame 5138 comprises two outer transverse beams 5140 extending perpendicularly to this plane. Two outer longitudinal beams 5142*a*, 5142*b* and two inner connecting beams 5144 extend between the transverse beams 5140. This is shown particularly clearly in FIG. 11.

The longitudinal beams 5142*a*, 5142*b* each support a lifting/lowering device 5146*a*, 5146*b* for one of the two stripping elements 5092*a*, 5092*b* in each case. Each lifting/lowering device 5146*a*, 5146*b* comprises a motor 5148*a*, 5148*b* which drives a rotary shaft 5150*a*, 5150*b* extending parallel to the longitudinal beams 5142. The rotary shafts 5150*a*, 5150*b* lead, at each end, into a respective drive block 5152*a*, 5152*b* which moves a respective linear chain 5154*a*, 5154*b*. The lifting/lowering device 5146*a* therefore comprises two linear chains 5154*a*, and the lifting/lowering device 5146*b* therefore comprises two linear chains 5154*b*. The lifting/lowering devices 5146*a*, 5148*b* thus form linear chain drives for the stripping elements 5092*a*, 5092*b*.

The drive blocks 5152*a*, 5152*b* transmit the rotational movement of the rotary shafts 5150*a*, 5150*b* in known manner to the linear chains 5154*a*, 5154*b* so that these are driven according to the direction of rotation of the rotary shafts 5150*a*, 5150*b*. The linear chains 5154*a*, 5154*b* are constructed in known manner such that they can transmit a force in both the pull direction and the push direction.

Each of the two linear chains 5154*a* is connected to the supporting frame 5138 at one end and to the stripping element 5092*a* at the other end. Accordingly, each of the two linear chains 5154*b* is connected to the supporting frame 5138 at one end and to the stripping element 5092*b* at the other end.

The drive blocks 5152*a* of the lifting/lowering device 5146*a* are arranged closer to one another on the longitudinal beam 5142*a* than the drive blocks 5152*b* on the longitudinal beam 5142*b*, so that the linear chains 5154*a* and 5154*b* extend offset from one another as seen in the direction of the transverse beam 5140, which is shown particularly clearly in FIG. 11.

From the drive blocks 5152*a*, 5152*b* above the supporting frame 5138, the linear chains 5154*a*, 5154*b* each run vertically downwards via an idle roller 5156*a*, 5156*b* to the respectively associated stripping element 5092*a* and 5092*b*.

The stripping elements 5092*a* and 5092*b* are of an identical construction and will now be explained using the example of the stripping element 5092*b* shown on the right in FIG. 9, with a separating plate 5044 arranged between the stripping elements 5092*a* and 5092*b* being used as a reference.

The stripping element 5092*b* comprises a stripping sheet 5158 which extends horizontally when in use and is long enough to project beyond the separating plate 5044 on both sides. The stripping sheet 5158 comprises a fixing portion 5160 which extends at an angle downwards towards the separating plate 5044 and merges into a less sharply inclined edge portion 5162 which finally leads into the stripping edge 5096.

A clamping strip 5164 is used to screw the stripping sheet 5158 to a holding strip 5166 by way of the fixing portion 5160. The holding strip 5166 is in turn fixed at its edge which is remote from the separating plate 5044 to two adjacently arranged vertical supporting plates 5168 (see also FIG. 10), so that a clearance remains between this and the separating plate 5044 (see FIG. 9).

On its side which is remote from the stripping sheet 5158, the holding strip 5164 supports a stripping strip 5170, which increases the stripping effect of the stripping element 5092*b*.

On their sides facing the separating plate 5044, the supporting plates 5168 support a plurality of electromagnets 5172 which are arranged in the longitudinal direction and can cooperate with corresponding electromagnets of the stripping element 5092*a* arranged on the opposite side of the separating plate 5044.

At their upper edge regions, the supporting plates 5168 are connected to a coupling web 5174 by way of which the linear chains 5154*b* are coupled to the stripping element 5092*b*.

Four rollers 5176 are rotatably mounted on the coupling web in such a way that the stripping element 5092 can run along the separating plate 5044.

Instead of the stripping sheets 5158, a stripping component which uses an air stream can also be present in the stripping elements 5092, as is the case in the stripping element 4092 according to FIG. 8.

The stripping device 5094 functions as follows:

Firstly, the electromagnets 5172 of the stripping elements 5092*a* and 5092*b* are deactivated. The separating plate 5044 which is to be freed of separating agent and overspray which has separated on this latter is pulled into the rail profile 82 by means of the clamping shoe 84 so that the separating plate 5044 comes to lie between the stripping elements 5092*a*, 5092 (see FIG. 9). If required, there can be provision for the stripping elements 5092*a*, 5092*b* to be kept at a spacing from one another so that there is no risk of the separating plate 5044 hitting one of the stripping elements 5092*a* or 5092*b* when it runs into the rail profile 82. To this end, the stripping elements 5092*a*, 5092*b* run in lateral guide rails, at least in the region downstream of the rail profile 82 for example, which guide the two stripping elements 5092*a*, 5092*b* away from one another.

When the separating plate 5044 has assumed its desired position in the rail profile 82, the electromagnets 5172 are activated. The stripping elements 5092*a*, 5092*b* are thus pulled against the separating plate 5044.

The electric motors 5148 of the lifting/lowering devices 5146 are then activated in such a way that the stripping elements 5092*a*, 5092*b* are pushed downwards along the separating plate 5044 by the linear chains 5154*a*, 5154*b*. The stripping sheets 5158 of the stripping elements 5092*a*, 5092*b* are held in constant contact with the separating plate 5044 by the magnetic force and the stripping elements 5092*a*, 5092*b* roll on their rollers 5176 over the separating surfaces 5046 and 5048 of the separating plate 5044.

On the downward path of the stripping elements 5092*a*, 5092*b*, the separating agent with the overspray separated thereon is scraped off both separating surfaces 5046 and 5048 of the separating plate 5044.

When the stripping elements 5092*a*, 5092*b* have reached their lowest position, the electric motors 5148 are operated in the opposite direction so that the stripping elements 5092*a*, 5092*b* are pulled back upwards by the linear chains 5154*a* and 5154*b*.

Separating-agent residues which may still be adhering to the separating plate 5044 can be detected and removed here by the separating strip 5170.

The separating-agent layer on the separating plate 5044 is otherwise renewed as explained above with reference to FIGS. 1 to 8.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for separating overspray from overspray-laden booth exhaust air of coating systems, the method comprising the steps of:

taking up the overspray by an air stream and conveying the overspray to an electrostatically operating separating device wherein solids are separated from the overspray on at least one separating surface; and, using an electrically conductive material or material mix as a separating agent, which is applied to the at least one separating surface of the separating device and which has a wax-like consistency at an operating temperature of the separating device.

2. The method according to claim 1, wherein the separating agent has a viscosity of greater than 2000 mPa s at the operating temperature.

3. The method according to claim 1, wherein the separating agent has a consistency similar to that of hard paraffin at the operating temperature.

4. The method according to claim 1, wherein the separating agent has a plastic consistency at the operating temperature.

5. The method according to claim 4, wherein the separating agent is kneadable or spreadable at the operating temperature.

6. The method according to claim 1, wherein the operating temperature is below approximately 28° C.

7. The method according to claim 1, wherein a viscosity of the separating agent reduces at a temperature above the operating temperature.

8. The method according to claim 1, wherein the separating agent is substantially inert with respect to the solids which are separated.

9. The method according to claim 1, wherein the separating agent comprises a grease, a paraffin, a soap, a wax, or a gel.

10. The method according to claim 1, wherein separating agent with separated solids which is present on the at least one separating surface is removed after an operating period and unladen separating agent is applied to the at least one separating surface.

11. The method according to claim 10, wherein the removal of separating agent with separated solids takes place by means of a stripping element, for which the at least one separating surface and the stripping element are moved relative to one another.

12. The method according to claim 10, wherein the application of unladen separating agent takes place by the at least one separating surface being moved into a dip bath filled with separating agent and out of the dip bath.

13. The method according to claim 10, wherein the application of unladen separating agent takes place by the separating agent being sprayed or squirted onto the at least one separating surface.

14. The method according to claim 10, wherein the operating period is approximately 2 hours, approximately 4 hours, approximately 6 hours, approximately 8 hours, approximately 10 hours, approximately 12 hours or several days.

15. A device for separating overspray from overspray-laden booth exhaust air of paint systems comprising:

a) at least one separating surface along which the overspray-laden booth exhaust air is conveyed and which is connected to a terminal of a high voltage source;

b) an electrode device which is arranged in the overspray-laden booth exhaust air, and which is associated with the at least one separating surface and which is connected to an other terminal of the high voltage source; and, c) an electrically conductive material or material mix is applied as a separating agent to the at least one separating surface and which has a wax-like consistency at an operating temperature of the device.

16. The device according to claim 15, wherein the separating agent has a viscosity of greater than 2000 mPa s at the operating temperature.

17. The device according to claim 15, wherein the separating agent has a consistency similar to that of hard paraffin at the operating temperature.

18. The device according to claim 15, wherein the separating agent has a plastic consistency at the operating temperature.

19. The device according to claim 18, wherein the separating agent is kneadable or spreadable at the operating temperature.

20. The device according to claim 15, wherein a viscosity of the separating agent reduces at a temperature above the operating temperature.

21. The device according to claim 15, wherein the separating agent is substantially inert with respect to the solids which are separated.

22. The device according to claim 15, wherein the separating agent comprises a grease, a paraffin, a soap, a wax, or a gel.

23. The device according to claim 15, further comprising: a separating-agent renewal device by means of which separating agent with separated solids which is present on the at least one separating surface can be removed and/or unladen separating agent can be applied to the at least one separating surface.

24. The device according to claim 23, wherein the separating-agent renewal device comprises at least one stripping element which can be moved relative to the at least one separating surface.

25. The device according to claim 24, wherein the at least one stripping element is coupled to a linear chain drive.

26. The device according to claim 24, wherein holding means are provided, by means of which the at least one stripping element is held at least temporarily in contact with the at least one separating surface.

27. The device according to claim 26, wherein the holding means comprise a magnet.

28. The device according to claim 24, wherein the at least one stripping element comprises at least one exit opening, from which a fluid exits.

29. The device according to claim 23, wherein the separating-agent renewal device comprises a dip bath filled with separating agent and a conveyor device by means of which the at least one separating surface is moved into and back out of the dip bath.

30. The device according to claim 23, wherein the separating-agent renewal device comprises a nozzle device by means of which the separating agent is sprayed or squirted onto the at least one separating surface.

31. The device according to claim 15, wherein the at least one separating surface is an outer face of a plate-shaped separating element.

32. The device according to claim 15, wherein the electrode device has a corona portion and a field portion, wherein the corona portion is arranged upstream of the field portion in a flow direction of the overspray-laden booth exhaust air.

33. A system for coating comprising:

a) a coating booth in which the objects are acted upon by coating material and through which an air stream can be conducted, and wherein the air stream takes up and removes overspray particles of the coating material; and, b) an electrostatically operating separating device constructed according to claim 15.

* * * * *